US008843044B2

(12) United States Patent
Hasegawa

(10) Patent No.: US 8,843,044 B2
(45) Date of Patent: Sep. 23, 2014

(54) FIXING DEVICE AND IMAGE FORMING APPARATUS INCORPORATING SAME

(75) Inventor: Kenichi Hasegawa, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 676 days.

(21) Appl. No.: 13/020,231

(22) Filed: Feb. 3, 2011

(65) Prior Publication Data

US 2011/0217094 A1 Sep. 8, 2011

(30) Foreign Application Priority Data

Mar. 5, 2010 (JP) ..... 2010-049359

(51) Int. Cl.
*G03G 15/20* (2006.01)

(52) U.S. Cl.
CPC ..... *G03G 15/20* (2013.01)
USPC ..... 399/329; 399/333; 219/216; 430/124.32

(58) Field of Classification Search
USPC ..... 399/329; 430/124.32
See application file for complete search history.

(56) References Cited

U.S. PATENT DOCUMENTS

| | | | | |
|---|---|---|---|---|
| 5,400,123 | A | 3/1995 | Sato et al. | |
| 6,131,009 | A | 10/2000 | Hasegawa | |
| 6,496,666 | B2 | 12/2002 | Hayashi et al. | |
| 6,591,081 | B2 | 7/2003 | Hasegawa | |
| 7,070,182 | B2 | 7/2006 | Hasegawa | |
| 7,515,850 | B2 | 4/2009 | Hasegawa | |
| 7,630,652 | B2 | 12/2009 | Hasegawa | |
| 8,160,484 | B2 * | 4/2012 | Hasegawa et al. | 399/329 |
| 8,213,827 | B2 * | 7/2012 | Shinshi et al. | 399/92 |
| 8,219,015 | B2 * | 7/2012 | Shinshi et al. | 399/329 |
| 8,219,016 | B2 * | 7/2012 | Hasegawa et al. | 399/329 |
| 8,311,469 | B2 * | 11/2012 | Yoshikawa et al. | 399/329 |
| 8,364,052 | B2 * | 1/2013 | Iwaya et al. | 399/69 |
| 8,385,804 | B2 * | 2/2013 | Yamaguchi et al. | 399/329 |
| 8,406,647 | B2 * | 3/2013 | Shinshi et al. | 399/69 |
| 8,417,169 | B2 * | 4/2013 | Hasegawa | 399/329 |

(Continued)

FOREIGN PATENT DOCUMENTS

| | | |
|---|---|---|
| JP | 2008-146010 | 6/2008 |
| JP | 2009-3410 | 1/2009 |

OTHER PUBLICATIONS

U.S. Appl. No. 13/026,945, filed Feb. 14, 2011, Ishii, et al.
U.S. Appl. No. 12/893,361, filed Sep. 29, 2010, Hasegawa, et al.

(Continued)

*Primary Examiner* — David Gray
*Assistant Examiner* — Geoffrey Evans
(74) *Attorney, Agent, or Firm* — Oblon, Spivak, McClelland, Maier & Neustadt, L.L.P.

(57) ABSTRACT

A fixing device includes a frame, a tubular heat pipe, a flexible fuser belt, a fuser pad, a pressure member, and a deformation relief mechanism. The heat pipe extends in an axial direction. The fuser belt is looped for rotation around the heat pipe. The fuser pad extends in the axial direction inside the loop of the fuser belt. The pressure member extends opposite the heat pipe in the axial direction. The fuser pad is pressed against the pressure member through the fuser belt in a load direction perpendicular to the axial direction to form a fixing nip. The heat pipe and the fuser pad establish stationary contact with each other at their respective axial ends upon formation of the fixing nip. The deformation relief mechanism is provided to at least one of the heat pipe and the fuser pad to relieve deformation of the fuser pad.

12 Claims, 8 Drawing Sheets

(56) References Cited

U.S. PATENT DOCUMENTS

| | | | | |
|---|---|---|---|---|
| 8,428,501 | B2 * | 4/2013 | Shinshi et al. | 399/329 |
| 8,447,220 | B2 * | 5/2013 | Yamaguchi et al. | 399/329 |
| 8,526,870 | B2 * | 9/2013 | Shinshi | 399/329 |
| 8,548,366 | B2 * | 10/2013 | Tokuda et al. | 399/329 |
| 8,588,670 | B2 * | 11/2013 | Shimokawa et al. | 399/334 |
| 8,676,101 | B2 * | 3/2014 | Yoshikawa et al. | 399/320 |
| 8,682,237 | B2 * | 3/2014 | Ishigaya et al. | 399/329 |
| 2006/0029411 | A1 | 2/2006 | Ishii et al. | |
| 2007/0014600 | A1 | 1/2007 | Ishii et al. | |
| 2008/0112739 | A1 * | 5/2008 | Shinshi | 399/329 |
| 2008/0175633 | A1 * | 7/2008 | Shinshi | 399/329 |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |
| 2010/0290822 | A1 | 11/2010 | Hasegawa et al. | |
| 2011/0026987 | A1 * | 2/2011 | Hasegawa | 399/329 |
| 2011/0044734 | A1 * | 2/2011 | Shimokawa et al. | 399/322 |
| 2011/0052237 | A1 * | 3/2011 | Yoshikawa et al. | 399/69 |
| 2011/0052245 | A1 * | 3/2011 | Shinshi et al. | 399/92 |
| 2011/0052282 | A1 * | 3/2011 | Shinshi et al. | 399/329 |
| 2011/0058862 | A1 * | 3/2011 | Yamaguchi et al. | 399/329 |
| 2011/0058863 | A1 * | 3/2011 | Shinshi et al. | 399/329 |
| 2011/0058864 | A1 * | 3/2011 | Fujimoto et al. | 399/329 |
| 2011/0058865 | A1 | 3/2011 | Tokuda et al. | |
| 2011/0058866 | A1 * | 3/2011 | Ishii et al. | 399/331 |
| 2011/0064437 | A1 * | 3/2011 | Yamashina et al. | 399/67 |
| 2011/0064443 | A1 | 3/2011 | Iwaya et al. | |
| 2011/0076071 | A1 | 3/2011 | Yamaguchi et al. | |
| 2011/0182638 | A1 * | 7/2011 | Ishii et al. | 399/333 |
| 2011/0194869 | A1 * | 8/2011 | Yoshinaga et al. | 399/69 |
| 2011/0200369 | A1 * | 8/2011 | Shinshi | 399/329 |
| 2012/0248097 | A1 * | 10/2012 | Takeuchi et al. | 219/635 |
| 2013/0330111 | A1 * | 12/2013 | Tokuda | 399/329 |
| 2014/0093288 | A1 * | 4/2014 | Naitoh et al. | 399/329 |
| 2014/0112691 | A1 * | 4/2014 | Nanno et al. | 399/329 |

OTHER PUBLICATIONS

U.S. Appl. No. 12/946,276, filed Nov. 15, 2010, Yamaguchi, et al.

* cited by examiner

FIXING DEVICE AND IMAGE FORMING APPARATUS INCORPORATING SAME

CROSS-REFERENCE TO RELATED APPLICATIONS

The present patent application claims priority pursuant to 35 U.S.C. §119 from Japanese Patent Application No. 2010-049359, filed on Mar. 5, 2010, which is hereby incorporated by reference herein in its entirety.

BACKGROUND OF THE INVENTION

1. Field of the Invention

The present invention relates to a fixing device and an image forming apparatus incorporating the same, and more particularly, to a fixing device that fixes a toner image in place on a recording medium with heat and pressure, and an electrophotographic image forming apparatus, such as a photocopier, facsimile machine, printer, plotter, or multifunctional machine incorporating several of those imaging functions, incorporating such a fixing device.

2. Discussion of the Background

In electrophotographic image forming apparatus, such as photocopiers, facsimiles, printers, plotters, or multifunctional machines incorporating several of those imaging functions, an image is formed by attracting toner particles to a photoconductive surface for subsequent transfer to a recording medium such as a sheet of paper. After transfer, the imaging process is followed by a fixing process using a fixing device, which permanently fixes the toner image in place on the recording medium by melting and settling the toner with heat and pressure.

Various types of fixing devices are known in the art, most of which employ a pair of generally cylindrical, looped belts or rollers, one being heated for fusing toner ("fuser member") and the other being pressed against the heated one ("pressure member"), which together form a heated area of contact called a fixing nip through which a recording medium is passed to fix a toner image onto the medium under heat and pressure.

One conventional type of fuser assembly employed in the fixing device is an endless belt looped for rotation around a generally cylindrical, stationary heat pipe typically formed of a thin sheet of thermally conductive metal, with a small gap or clearance on the order of approximately 1 mm or less left between the adjoining surfaces of the belt and the heat pipe. The heat pipe has a heater inside to conduct or carry heat over its circumference, from which heat is radially transferred to the length of the fuser belt rotating around the heat pipe.

Using a thin-walled conductive heat pipe allows for heating the fuser belt swiftly and uniformly, resulting in shorter warm-up time and first-print time required to complete an initial print job upon startup, and high immunity against printing failures caused by insufficient heating of the fixing nip in high-speed application. For obtaining an extreme thinness, the heat pipe is typically formed by bending a sheet of thermally conductive material or metal through metalworking process into the require shape.

To date, a generally cylindrical, open-sided heat pipe is available for use in the conventional fixing device, which comprises a thin sheet of metal formed into a rolled configuration with two opposed longitudinal edges thereof spaced apart from each other to obtain a substantially C-shaped cross-section with an elongated opening on one side thereof. The open-sided heat pipe is used in combination with a separate fuser pad held stationary in its side opening outside the pipe interior and inside the loop of a fuser belt entrained around the heat pipe. When assembled, the open-sided heat pipe has its open side facing a pressure member extending parallel to the length of the pipe, so that the fuser pad is pressed against the pressure member through the thickness of the fuser belt to form a fixing nip.

Provision of the separate fuser pad enables the open-sided heat pipe to operate substantially in isolation from the pressure member, which can thus maintain its generally cylindrical configuration without bending or bowing away from the fixing nip under nip pressure, even where the heat pipe is extremely thin-walled to obtain high thermal efficiency in heating the fuser belt. Such stability against deformation of the heat pipe maintains a proper clearance between the fuser belt and the heat pipe, which in turn protects the fuser belt against damage and failure and results in proper operation of the fixing device.

One drawback encountered when using an open-sided heat pipe is the difficulty in establishing an adequate, uniform clearance between the fuser belt and the heat pipe during manufacture. The problem arises primarily due to dimensional variations in the open-sided heat pipe, whose generally cylindrical shape is difficult to fabricate with precision and vulnerable to deformation during handling, leading to variations in the size of the gap between the fuser belt and the heat pipe. Process variations occurring during assembly of separate pieces of fuser equipment also contribute to variations in the belt-to-pipe gap.

Failure to provide a proper clearance between the fuser belt and the heat pipe results in defects and failures of the fixing device. For example, too small a belt-to-pipe gap causes the fuser belt to rub against the heat pipe locally and intensively, resulting in various problems, such as scuffing of or other damage to the fuser belt, grating noise caused during operation, or disturbed motion of the fuser belt sliding against the heat pipe. On the other hand, too large a belt-to-pipe gap hinders transfer of heat from the heat pipe to the fuser belt, and destabilizes rotation of the fuser belt around the heat pipe.

Another drawback associated with the open-sided heat pipe is the difficulty in handling the fuser assembly for repair or replacement. That is, providing the heat pipe, the fuser pad, and the fuser belt (which are in most cases consumable) as separate pieces of fuser equipment results in cumbersome disassembly and assembly of the fixing device where those consumables need maintenance or replacement.

Still another drawback is that the fuser pad tends to bow or bend in the axial direction under pressure from the pressure roller. Such tendency to deformation is inherent in a typical design where the fuser pad has a pair of axial, longitudinal ends thereof secured to a frame of the fixing device without provision of other fastening structure that holds an axial center of the fuser pad in place due to the presence of the fuser belt entrained around the heat pipe. Deformation of the fuser pad results in variations in the width and strength of the fixing nip in the axial direction, leading to poor imaging performance of the fixing device.

To overcome the drawbacks of the conventional configuration, another type of heat pipe has been proposed that comprises a completely closed cylindrical pipe formed by bending a sheet of metal into a rolled configuration with two opposed longitudinal edges thereof bent inward and joined together to obtain a completely closed cross-section with an elongated side slot on one side thereof.

The completely closed heat pipe has a separate fuser pad held stationary in its side slot outside the pipe interior and inside the loop of a fuser belt entrained around the heat pipe, as well as a reinforcing member held stationary against the inner circumference of the pipe for reinforcement purposes. When assembled, the completely closed heat pipe has its outer circumference facing a pressure member extending parallel to the length of the pipe, with the reinforcing member supporting those portions of the pipe circumference pressed against the pressure member to form a fixing nip.

Compared to the open-sided configuration, the completely closed heat pipe is exempt from dimensional variations, as the opposed edges of the bent sheet of material are joined together to retain the cylindrical shape during handling. Moreover, accommodating the fuser pad in the side slot of the heat pipe allows for integrating the heat pipe and the fuser pad into a single integrated unit. Such integration of fuser assembly prevents variations in the gap between the heat pipe and the fuser belt, while facilitating assembly and disassembly of the fuser belt, the fuser pad, and the heat pipe during repair or replacement of those consumables. Furthermore, providing the fuser pad with the reinforcing member inside the heat pipe prevents deformation of the fuser pad and the heat pipe under pressure from the pressure roller.

Although generally successful for its intended purpose, the completely closed heat pipe is still susceptible to deformation when adapted to fast printing process. That is, designing a fixing device for high-speed operation involves reducing the overall size of the fuser belt and the heat pipe and thinning the wall of heat pipe to minimize warm-up time, as well as increasing nip pressure to accelerate fusing of toner. Such optimization for high-speed application, however, makes the heat pipe as well as the fuser belt and the reinforcing member more vulnerable to deformation than those used in relatively slow imaging processes.

As mentioned above, deformation of the heat pipe causes variations in the size of the gap between the fuser belt and the heat pipe, which result in various defects and failures of the fixing device. The problem becomes particularly noticeable where the fixing device incorporates the capability to adjust the length and pressure of the fixing nip by moving the pressure member relative to the heat pipe, which can stress the heat pipe upon touching or striking the pressure member at different pressures.

SUMMARY OF THE INVENTION

Exemplary aspects of the present invention are put forward in view of the above-described circumstances, and provide a novel fixing device that fixes a toner image in place on a recording medium.

In one exemplary embodiment, the novel fixing device includes a frame, a tubular heat pipe, a flexible fuser belt, a fuser pad, a pressure member, and a deformation relief mechanism. The frame defines a space in which the fixing device is installed. The tubular heat pipe extends in an axial direction with a pair of opposed axial ends thereof held stationary with respect to the frame. A circumference of the heat pipe is subjected to heating. The flexible fuser belt is looped for rotation around the heat pipe. An inner circumference of the fuser belt is at least partially facing the heat pipe to transfer heat from the heated circumference of the heat pipe. The fuser pad extends in the axial direction inside the loop of the fuser belt and parallel to the heat pipe, with a pair of opposed axial ends thereof held stationary with respect to the frame. The pressure member extends opposite the heat pipe in the axial direction, with the fuser belt interposed between the fuser pad and the pressure member. The fuser pad is pressed against the pressure member through the fuser belt in a load direction perpendicular to the axial direction to form a fixing nip through which a recording medium is passed to fix a toner image thereupon under heat and pressure. The heat pipe and the fuser pad establish stationary contact with each other at their respective axial ends upon formation of the fixing nip. The deformation relief mechanism is provided to at least one of the heat pipe and the fuser pad to relieve deformation of the fuser pad between the opposed axial ends where the fuser pad bends under pressure in the load direction.

Other exemplary aspects of the present invention are put forward in view of the above-described circumstances, and provide a novel image forming apparatus.

In one exemplary embodiment, the image forming apparatus includes an electrophotographic imaging unit and the fixing device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
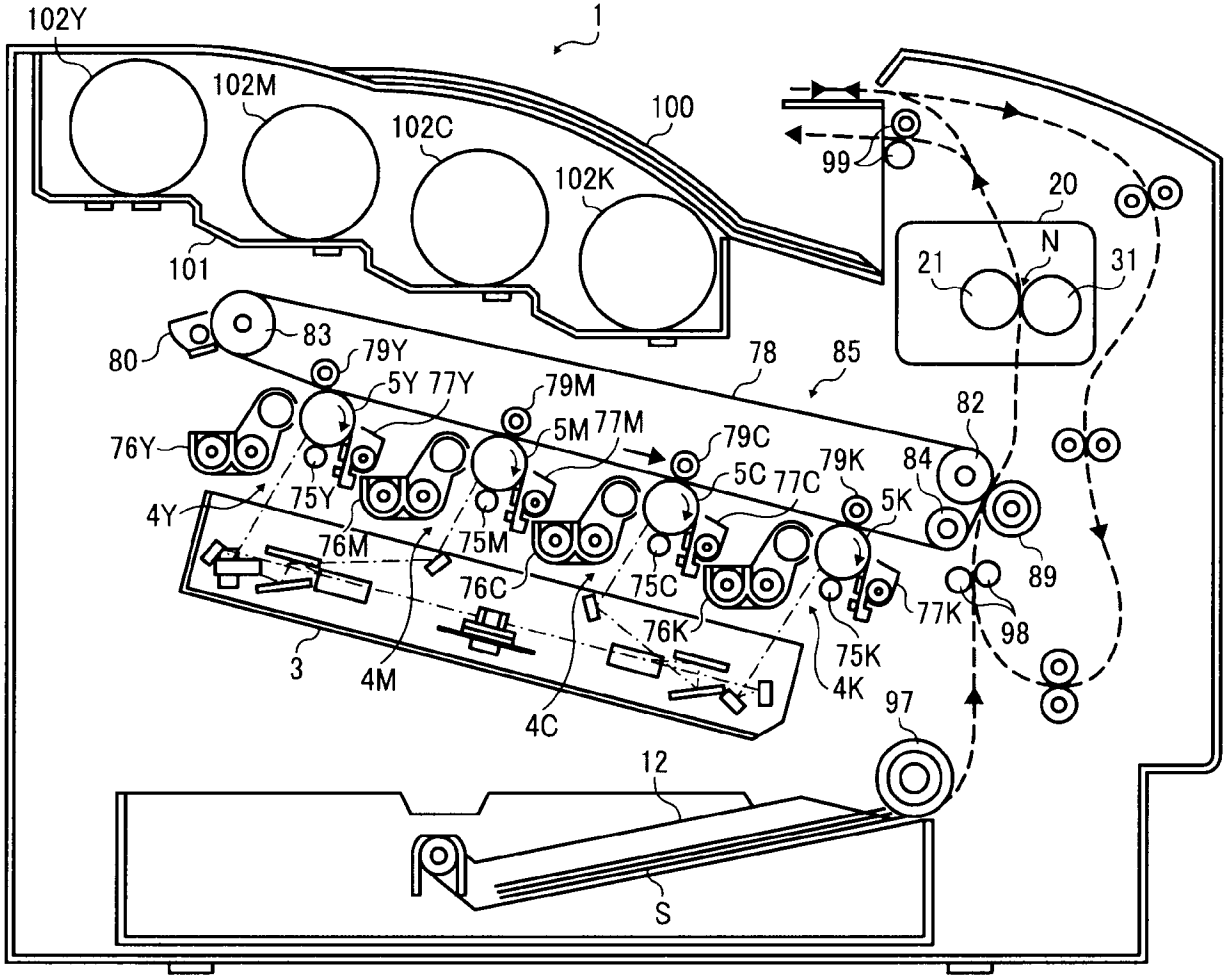
FIG. 1 schematically illustrates an image forming apparatus incorporating a fixing device according to one embodiment of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 1 incorporating a fixing device 20 according to one embodiment of this patent specification.

As shown in FIG. 1, the image forming apparatus 1 is a tandem color printer including four imaging stations 4Y, 4M, 4C, and 4K arranged in series along the length of an intermediate transfer unit 85 and adjacent to a write scanner 3, which together form an electrophotographic mechanism to form an image with toner particles on a recording medium such as a sheet of paper S, for subsequent processing through the fixing device 20 located above the intermediate transfer unit 85. The image forming apparatus 1 also includes a feed roller 97, a pair of registration rollers 98, a pair of discharge rollers 99, and other conveyor and guide members together defining a sheet conveyance path, indicated by broken lines in the drawing, along which a recording sheet S advances upward from a bottom sheet tray 12 accommodating a stack of recording sheets toward the intermediate transfer unit 85 and then through the fixing device 20 to finally reach an output tray 100 situated atop the apparatus body.

In the image forming apparatus 1, each imaging unit (indicated collectively by the reference numeral 4) has a drum-shaped photoconductor 5 surrounded by a charging device 75, a development device 76, a cleaning device 77, a discharging device, not shown, etc., which work in cooperation to form a toner image of a particular primary color, as designated by the suffixes "Y" for yellow, "M" for magenta, "C" for cyan, and "K" for black. The imaging units 4Y, 4M, 4C, and 4K are supplied with toner from replaceable toner bottles 102Y, 102M, 102C, and 102K, respectively, accommodated in a toner supply 101 in the upper portion of the apparatus 1.

The intermediate transfer unit 85 includes an intermediate transfer belt 78, four primary transfer rollers 79Y, 79M, 79C, and 79K, a secondary transfer roller 89, and a belt cleaner 80, as well as a transfer backup roller or drive roller 82, a cleaning backup roller 83, and a tension roller 84 around which the intermediate transfer belt 78 is entrained. When driven by the roller 82, the intermediate transfer belt 78 travels counterclockwise in the drawing along an endless travel path, passing through four primary transfer nips defined between the primary transfer rollers 79 and the corresponding photoconductive drums 5, as well as a secondary transfer nip defined between the transfer backup roller 82 and the secondary transfer roller 89.

The fixing device 20 includes a fuser member 21 and a pressure member 31, one being heated and the other being pressed against the heated one, to form an area of contact or a "fixing nip" N therebetween in the sheet conveyance path. A detailed description of the fixing device 20 will be given later with reference to FIG. 2 and subsequent drawings.

During operation, each imaging unit 4 rotates the photoconductor drum 5 clockwise in the drawing to forward its outer, photoconductive surface to a series of electrophotographic processes, including charging, exposure, development, transfer, and cleaning, in one rotation of the photoconductor drum 5.

First, the photoconductive surface is uniformly charged by the charging device 75 and subsequently exposed to a modulated laser beam emitted from the write scanner 3. The laser exposure selectively dissipates the charge on the photoconductive surface to form an electrostatic latent image thereon according to image data representing a particular primary color. Then, the latent image enters the development device which renders the incoming image visible using toner. The toner image thus obtained is forwarded to the primary transfer nip between the intermediate transfer belt 78 and the primary transfer roller 79.

At the primary transfer nip, the primary transfer roller 79 applies a bias voltage of a polarity opposite that of toner to the intermediate transfer belt 78. This electrostatically transfers the toner image from the photoconductive surface to an outer surface of the belt 78, with a certain small amount of residual toner particles left on the photoconductive surface. Such transfer process occurs sequentially at the four transfer nips along the belt travel path, so that toner images of different colors are superimposed one atop another to form a single multicolor image on the surface of the intermediate transfer belt 78.

After primary transfer, the photoconductive surface enters the cleaning device 77 to remove residual toner by scraping it off with a cleaning blade, and then to the discharging device to remove residual charges for completion of one imaging cycle. At the same time, the intermediate transfer belt 78 forwards the multicolor image to the secondary transfer nip between the transfer backup roller 82 and the secondary transfer roller 89.

In the sheet conveyance path, the feed roller 97 rotates counterclockwise in the drawing to introduce a recording sheet S from the sheet tray 12 toward the pair of registration rollers 98 being rotated. Upon receiving the fed sheet S, the registration rollers 98 stop rotation to hold the incoming sheet S therebetween, and then advance it in sync with the movement of the intermediate transfer belt 78 to the secondary transfer nip. At the secondary transfer nip, the multicolor image is transferred from the belt 78 to the recording sheet S, with a certain small amount of residual toner particles left on the belt surface.

After secondary transfer, the intermediate transfer belt 78 enters the belt cleaner 80, which removes and collects residual toner from the intermediate transfer belt 78. At the same time, the recording sheet S bearing the powder toner image thereon is introduced into the fixing device 20, which fixes the multicolor image in place on the recording sheet S with heat and pressure through the fixing nip N.

Thereafter, the recording sheet S is ejected by the discharge rollers 99 to the output tray 100 for stacking outside the apparatus body, which completes one operational cycle of the image forming apparatus 1.

Figure 2:
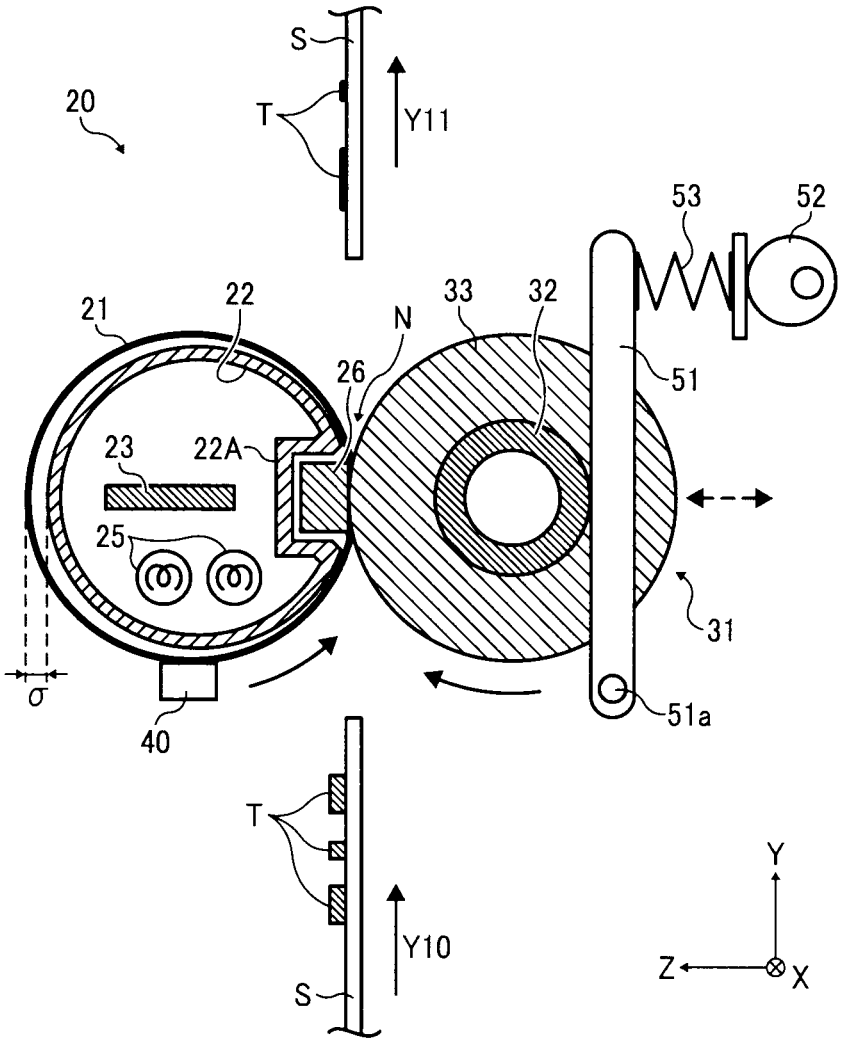
FIG. 2 is an end-on, axial cutaway view schematically illustrating the fixing device incorporated in the image forming apparatus of FIG. 1.
Figure 3:
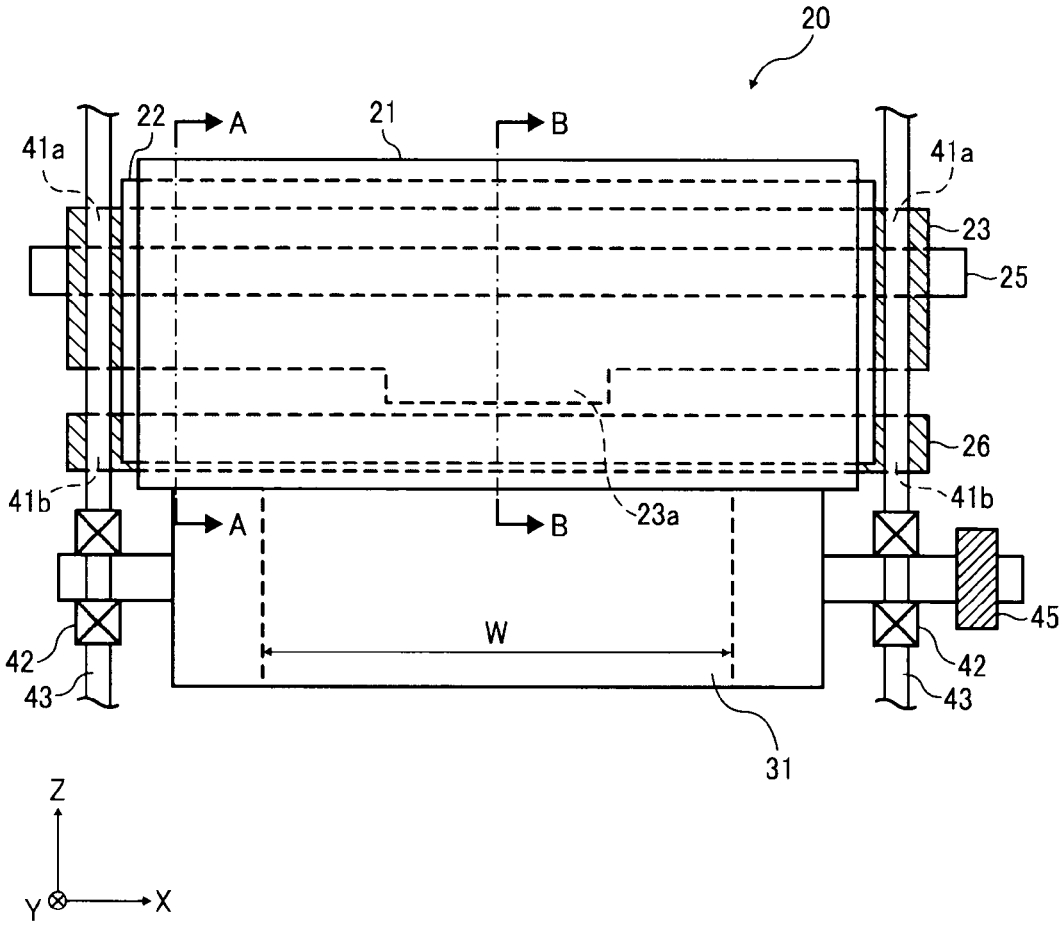
FIG. 3 is a transverse view schematically illustrating the fixing device of FIG. 2.

FIGS. 2 and 3 are end-on, axial cutaway and transverse views, respectively, schematically illustrating the fixing device 20 incorporated in the image forming apparatus 1 according to this patent specification.

As shown in FIGS. 2 and 3, the fixing device 20 includes a stationary, tubular heat pipe 22, a rotatable, endless fuser belt 21 looped into a generally cylindrical configuration for rotation around the heat pipe 22, and a stationary, elongated fuser pad 26 disposed inside the loop of the fuser belt 21 and adjacent to the heat pipe 22, as well as a rotatable pressure roller 31 disposed opposite the heat pipe 22, all of which extend in an axial, longitudinal direction X between a pair of sidewalls 43 that constitute a frame of the fixing device 20.

The pressure roller 31 presses against the fuser pad 26 via the fuser belt 21 in a trans-axial, load direction Z perpendicular to the axial direction X to form a fixing nip N therebetween, through which a recording sheet S is passed in a trans-axial, sheet feed direction Y perpendicular to the axial and load directions X and Z to fix a toner image T thereupon under heat and pressure. The heat pipe 22 faces the inner surface of the looped belt 21 except at the fixing nip N where the fuser pad 26 slidably contacts the inner surface of the fuser belt 21.

The heat pipe 22 and the fuser pad 26 establish stationary contact with each other at their respective axial ends upon formation of the fixing nip N. The heat pipe 22 and the fuser pad 26 both have their respective axial ends held stationary with respect to the sidewalls 43.

With continued reference to FIGS. 2 and 3, disposed within the heat pipe 22 are a stationary reinforcing member 23 and a stationary heating assembly 25, each extending in the axial direction X with two opposed axial ends thereof secured to the sidewalls 43. The reinforcing member 23 reinforces the fuser pad 26 where it is subjected to pressure from the pressure roller 31. The heating assembly 25 is formed of one or more radiant heaters which irradiate the inner side of the pipe 22 for heating the fuser belt 21. A thermometer 40 is disposed adjacent to the surface of the fuser belt 21 to detect the temperature of the belt surface for controlling operation of the heating assembly 25.

The pressure roller 31 has two opposed axial ends thereof rotatably held on the sidewalls 43 via a pair of bearings 42, one of which is connected to a drive motor, not shown, via a gear train 45 outside the sidewalls 43 for imparting a rotational force to the roller 31. The pressure roller 31 is pressed against the fuser belt 21 by a biasing mechanism consisting of a pressure lever 51, a motor-driven eccentric cam 52, and a spring 53, connected to the roller bearing 42 to adjust position of the roller 31 with respect to the fuser assembly to adjust the length or width of the fixing nip N along the sheet conveyance path of the image forming apparatus 1.

During operation, the fixing device 20 activates the roller drive motor and the heaters 25 as the image forming apparatus 1 is powered up. Upon activation, the heaters 25 start heating the heat pipe 22 by radiation, which eventually heats the fuser belt 21 to a processing temperature by conduction through the wall of the heat pipe 22. At the same time, the motor-driven pressure roller 31 starts rotation clockwise in FIG. 2 in frictional contact with the fuser belt 21, which in turn rotates around the heat pipe 22 counterclockwise in FIG. 2.

Then, a recording sheet S with an unfixed, powder toner image T enters the fixing device 20 with its printed side brought into contact with the fuser belt 21 and the other side with the pressure roller 31. Upon reaching the fixing nip N, the recording sheet S moves along the rotating surfaces of the belt 21 and the roller 31 in the direction of arrow Y10 perpendicular to the axial direction X, substantially flat and erect along surfaces of guide plates, not shown, disposed along the sheet conveyance path.

At the fixing nip N, the fuser belt 21 heats the incoming sheet S to fuse and melt the toner particles T, while the pressure roller 31 presses the sheet S against the fuser pad 26 to cause the molten toner T to settle onto the sheet surface. As the toner image T is thus fixed in place through the fixing nip N, the recording sheet S is forwarded to exit the fixing device 20 in the direction of arrow Y11.

As used herein, the term "stationary" or "disposed stationary" refers to a condition of the fuser pad 26, the heat pipe 22, the reinforcing member 23, and other pieces of fixing equipment, in which those members remain still and do not rotate as the pressure member 31 and the fuser belt 21 rotate during operation. Hence, a stationary member may still be subjected to mechanical force or pressure resulting from its intended use (e.g., the fuser pad 26 pressed against the pressure member 31 by a biasing member), but only to an extent that does not cause substantial movement, rotation, or displacement of the stationary member.

Also, the term "stationary contact" is used to describe a state of contact between a pair of different stationary members, in particular, between the heat pipe 22 and the fuser pad 26, wherein the stationary pair contacts each other when pressure is applied in the load direction Z to hold them stationary in position with respect to each other but without secure, fixed connection, such as screwing or adhesion.

Further, as used herein, the term "maximum compatible width" refers to a maximum width of recording sheet (denoted as "W" in FIG. 3) that the fixing device 20 can accommodate through the fixing nip N. Unless specifically indicated otherwise, this term is used to describe the dimensions of the recording sheet, in particular the width or length of the recording sheet along the axial direction X of the fuser sleeve 21 at the fixing nip N.

In the present embodiment of the fixing device 20, the fuser belt 21 comprises a thin, multi-layered, looped flexible belt approximately 1 mm or less in thickness and ranging from approximately 15 to 120 mm in diameter in its generally cylindrical looped shape (with an inner diameter of about 30 mm in the present embodiment), the overall length of which is formed of a substrate covered with an intermediate elastic layer and an outer release coating deposited thereon, one atop another.

Specifically, the belt substrate may be a layer of metal or resin, such as nickel, stainless steel, polyimide, or the like, approximately 30 to 50 μm in thickness. The intermediate elastic layer may be a deposit of rubber, such as solid or foamed silicone rubber, fluorine resin, or the like, approximately 100 to 300 μm in thickness. The outer coating may be a deposit of a release agent, such as tetra fluoro ethylene-perfluoro alkylvinyl ether copolymer or PFA, polytetrafluoroethylene (PTFE), polyimide (PI), polyetherimide (PEI), polyethersulfide (PES), or the like, approximately 10 to 50 μm in thickness.

The intermediate elastic layer serves to accommodate minute variations in applied pressure to maintain smoothness of the belt surface at the fixing nip N, which ensures uniform distribution of heat across a recording sheet S to yield a resulting image with a smooth, consistent appearance. Further, the release coating layer provides good stripping of toner from the belt surface to ensure reliable conveyance of recording sheets S through the fixing nip N.

Inside the loop of the fuser belt 21 is the fuser pad 26, disposed stationary with its opposed axial ends engaged in the sidewalls 43 for positioning in the trans-axial directions Y and Z, facing the pressure roller 31 and accommodated within the heat pipe 22.

Figure 4:
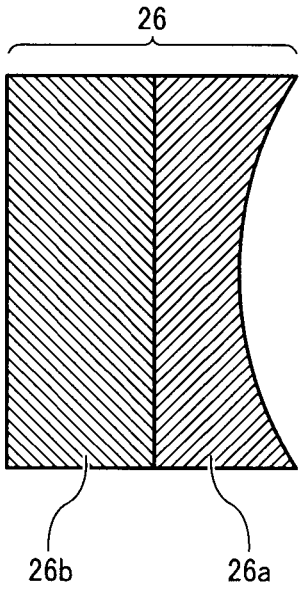
FIG. 4 is an enlarged, axial cross-sectional view schematically illustrating a fuser pad for use in the fixing device of FIGS. 2 and 3.

With additional reference to FIG. 4, which is an enlarged, axial cross-sectional view schematically illustrating the fuser pad 26, the fuser pad 26 is shown having a composite structure consisting of an elastic portion 26*a* and a stiff portion 26*b*, the former disposed on a first side to face the pressure roller 31 through the fuser belt 21 at the fixing nip N, the latter disposed on a second side opposite the first side to withstand pressure from the pressure roller 31.

Specifically, the elastic portion 26*a* is formed of rubber and disposed where the fuser pad 26 faces the pressure member 31 through the fuser belt 21 to form the fixing nip N, with its exposed side defining a pliant contact surface to slide against the pressure roller 31 through the fuser belt 21. The stiff portion 26*b* is formed of sufficiently stiff material, such as rigid metal or ceramic, to withstand pressure from the pressure roller 31 without deformation. A sheet impregnated with lubricant such as fluorine grease may be disposed around the fuser pad 26 to reduce friction between the fuser pad 26 and the fuser belt 21.

The elastic portion 26*a* closely conforms to minute irregularities in the surface of a toner image processed through the fixing nip N for obtaining good fusing performance, with its contact surface available in various configurations according to particular applications of the fixing device 20.

For example, the contact surface of the elastic portion 26*a* may be slightly concave with a curvature similar to that of the circumference of the pressure roller 31, as is the case with the embodiment shown in FIG. 4. The concave contact surface readily conforms to the surface of the pressure roller 31 along which a recording sheet S passes through the fixing nip N, which ensures reliable conveyance of the sheet S without the sheet S adhering to and wrapping around the fuser belt 21 upon exiting the fixing nip N.

Alternatively, instead of the concave configuration, the contact surface of the elastic portion 26*a* may be substantially flat. The flat contact surface causes a recording sheet S to remain straight and uniformly contact the fuser belt 21 within the fixing nip N, resulting in efficient fusing performance, while allowing for good stripping of the recording sheet S from the fuser belt 21 which exhibits a curvature larger at the exit of the fixing nip N than within the fixing nip N.

Referring back to FIGS. 2 and 3, also inside the loop of the fuser belt 21 is the heat pipe 22, inside which rest the reinforcing member 23 and the heating assembly 25.

As shown in FIGS. 2 and 3, the heat pipe 22 comprises a tubular, generally cylindrical member of a conductive material, such as stainless steel, aluminum, iron, or other suitable metal, extending in the axial direction X and defining a longitudinal side slot 22A on one side thereof within which the fuser pad 26 is accommodated facing the pressure roller 31. The side slot 22A serves to engage with the fuser pad 26 for positioning it in the load direction Z as well as in the sheet feed direction Y. Specific configurations of the heat pipe 22 will be described later in more detail with reference to FIGS. 7A and 7B and subsequent drawings.

Preferably, the heat pipe 22 is formed of a sheet of metal approximately 0.2 mm or less, and more preferably, approximately 0.1 mm or less. Forming the heat pipe 22 with a wall thickness not exceeding 0.2 mm is desirable for promptly heating the pipe circumference to a processing temperature during operation. In the present embodiment, the heat pipe 22 is formed of stainless steel approximately 0.1 mm thick.

More preferably, the heat pipe 22 has its tubular body internally coated with heat-resistant, black absorptive material where the inner circumference of the fuser belt 21 faces the heat pipe 22 outside. Such absorptive coating enables the coated area of the tubular body to effectively absorb radiation from the heater assembly 25 where the inner circumference of the fuser belt 21 faces the heat pipe 22 outside, leading to enhanced heating efficiency in the fixing device 20.

With further reference to FIG. 2, there is a gap or clearance δ smaller than 1 mm between the inner circumference of the fuser belt 21 and the outer circumference of the heat pipe 22. Maintaining the gap δ between the fuser belt 21 and its adjacent surfaces prevents the elastic belt surface from premature wear caused by excessive rubbing. Moreover, holding the gap δ within an adequate range ensures efficient heat transfer from the heat pipe 22 to the fuser belt 21, which prevents failures caused by insufficient heating at the fixing nip N. For maximizing these effects, it is desirable to maintain the gap δ uniformly, that is, consistently and without variations in size during operation.

Note that, as shown in FIG. 2, the heat pipe 22 and the fuser pad 26, with their respective axial ends disposed stationary with respect to the sidewalls 43, together define a closed curved surface with a circumference thereof smaller than the inner circumference of the fuser belt 21. With the small gaps left between the fuser belt 21 and its adjacent surfaces, the fuser belt 21 may move along the closed curved surface during rotation around the heat pipe 22. This allows the elastic fuser belt 21 to maintain its generally cylindrical configuration while preventing variations in the dimension of the gap δ, thereby protecting the belt 21 against deterioration and breakage resulting from deformation.

In addition, the fuser belt 21 and the heat pipe 22 are provided with a lubricating agent, such as fluorine grease, deposited between their adjoining surfaces. The lubricant reduces friction at the interface to prevent wear and tear on the fuser belt 21 even when operated in continuous frictional contact with the heat pipe 22.

The reinforcing member 23 comprises a flat elongated beam of rigid material such as stainless steel approximately 3 mm in thickness, having a length substantially equal to that of the fuser pad 26. The reinforcing member 23 is disposed stationary with its opposed axial ends engaged in the sidewalls 43 for positioning in the sheet feed direction Y.

The heating assembly 25 comprises one or more radiant heaters, such as halogen heaters or carbon heaters. To warm up the fixing device 20, the radiation heating assembly 25 heats the metal roller 22 directly through radiation, and the fuser belt 21 indirectly through conduction from the metal roller 22 being heated. That is, the heaters 25 irradiate the inner circumference of the heat pipe 22, which then conducts heat to those portions of the fuser belt 21 in the proximity of the pipe circumference (i.e., except where the belt circumference faces the fuser pad 26). As the fuser belt 21 rotates, this results in uniformly heating the entire length of the rotating belt 21 sufficiently for fusing toner at the fusing nip N.

Such heating is controlled by regulating a power supply to the respective heaters 25 according to readings of the thermometer 40 sensing temperatures of the outer circumference of the fuser belt 21 to maintain the belt surface at a desired processing temperature.

Thus, the fuser belt 21 has its length heated substantially continuously and uniformly by conduction from the outer circumference of the metal roller 22 being internally heated by irradiation with heat from the heaters 25. Compared to directly and locally heating portions of a fuser member, such indirect continuous heating can warm up the entire length of the fuser belt 21 swiftly and efficiently with a relatively simple configuration, which allows the fixing device 20 to operate at higher processing speeds without causing image defects due to premature entry of recording sheets into the fixing nip N. This leads to a reduction in warm-up time and first-print time required for completing an initial print job upon startup, while maintaining a compact size of the image forming apparatus 1 incorporating the fixing device 20.

In the present embodiment, the heating assembly 25 includes a pair of elongated heaters extending in the axial direction X, one dedicated to heat a longitudinal center of the heat pipe 22, and the other dedicated to heat two longitudinal ends of the heat pipe 22. For example, the heating assembly 25 may have a central heater facing a center portion extending approximately 210 mm (equal to the length of the shorter edge of an A4-size copy sheet) along the axial direction X, and a sub-central heater facing an end portion extending approximately 297 mm (equal to the length of the shorter edge of an A3-size copy sheet) along the axial direction X except for the 210-mm center portion.

In this arrangement, the fixing device 20 can heat a desired area of the heat pipe 22 by selectively activating either or both of the paired heaters 25 depending on the size of recording sheet S in use. For example, when processing an A4-size copy sheet with its longer edge directed along the sheet conveyance path (i.e., with its shorter edges as the leading and trailing edges), the fixing device 20 activates only the central heater for heating the longitudinal center of the heat pipe 22. By contrast, when processing an A3-size copy sheet with its longer edge directed along the sheet conveyance path (i.e., with its shorter edges as the leading and trailing edges), or when processing an A4-size copy sheet with its shorter edge directed along the sheet conveyance path (i.e., with its longer edges as the leading and trailing edges), the fixing device 20 activates both the central and sub-central heaters for heating the entire length of the heat pipe 22.

Thus, selective activation of the pair of heaters 25 enables the fixing device 20 to heat a desired area of the heat pipe 22, so as not to excessively heat the longitudinal ends of the heat pipe 22 where the fixing device 20 processes recording sheets S of relatively small size in succession. The configuration of the heating assembly 25 is not limited to that depicted in the present embodiment, and the heating assembly 25 may be configured with any number and configuration of heaters depending on specific application of the fixing device 20.

With still continued reference to FIGS. 2 and 3, the pressure roller 31 comprises a cylindrical rotatable body approximately 30 mm in diameter, formed of a hollow, cylindrical metal core 32 covered with an outer layer 33 of elastic material, such as foamed or solid silicone rubber, fluorine rubber, or the like, and optionally, with an additional coating of a release agent, such as PFA, PTFE, or the like, deposited on the elastic layer 33. Further, the pressure roller 31 may have a heating element, such as a halogen heater, within the interior of the hollow roller core 32.

Forming the roller outer layer 33 with sponge material is advantageous, since it prevents excessive nip pressure, which would otherwise cause the heat pipe 22 to substantially bend away from the pressure roller 31 at the fixing nip N. Another advantage is that it provides favorable thermal insulation at the fixing nip N to prevent heat transfer from the fuser belt 21 to the pressure roller 31, leading to enhanced heating efficiency in the fixing device 20.

Although the fuser belt 21 and the pressure roller 31 are of a substantially identical diameter in the embodiment depicted in FIGS. 2 and 3, instead, it is possible to provide the cylindrical fixing members 21 and 31 with different diameters, in particular, the fuser belt 21 with a relatively small diameter and the pressure roller 31 with a relatively large diameter. Forming the fuser belt 21 with a diameter smaller than that of the pressure roller 31 translates into a greater curvature of the fuser belt 21 than that of the pressure roller 31 at the fixing nip N, which effects good stripping of a recording sheet from the fuser belt 21 upon exiting the fixing nip N.

As mentioned, the pressure roller 31 is equipped with the biasing mechanism formed of the pressure lever 51, the eccentric cam 52, and the spring 53. The pressure lever 51 has one hinged end provided with a hinge 51*a* and another, free end loaded with the spring 53 connected to the eccentric cam 52 via a spacer, while supporting the rotational axis of the pressure roller 31 via the roller bearing 42 held on an elongated slot defined in the sidewall 43 displaceably with an appropriate allowance for movement. The eccentric cam 52 is driven for rotation by a motor, not shown, to cause the pressure lever 51 to swivel on the hinge 51*a*, which in turn displaces the pressure roller 31 either toward or away from the fuser belt 21.

Such biasing mechanism enables the fixing device 20 to move the pressure roller 31 into pressure contact with the fuser belt 21 to form a desired fixing nip by setting the eccentric cam 52 to an operating position (i.e., such as one depicted in FIG. 2) upon entering operation, and to retract the pressure roller 31 away from the fuser belt 21 to remove nip pressure by rotating the eccentric cam 52 by 180 degrees from the operating position when out of operation or under maintenance where normal operation is suspended for correcting faults such as paper getting jammed in the fixing nip N.

Figure 5:
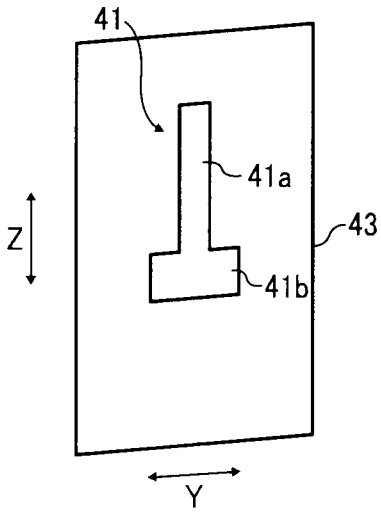
FIG. 5 is a perspective view schematically illustrating an example of a frame for use in the fixing device of FIGS. 2 and 3.

FIG. 5 is a perspective view schematically illustrating an example of the sidewall or frame 43 of the fixing device 20.

As shown in FIG. 5, the sidewall 43 has an opening or cutout 41 defined therein to engage with the axial ends of the reinforcing member 23 and the fuser pad 26. The cutout 41 consists of a first section 41*a* extending in the load direction Z for accommodating the axial end of the reinforcing member 23, and a second section 41*b* extending in the sheet feed direction Y for accommodating the axial end of the fuser pad 26. The first section 41*a* is dimensioned to fit with the reinforcing member 23 closely in the sheet feed direction Y but loosely in the load direction Z, whereas the second section 41*b* is dimensioned to closely fit with the fuser pad 26 in the load direction Z as well as in the sheet feed direction Y.

Figure 6A:
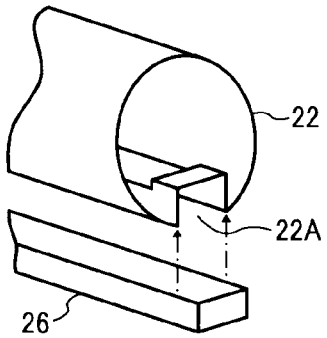
FIGS. 6A through 6D schematically illustrate the fixing device of FIGS. 2 and 3 during assembly.
Figure 6B:
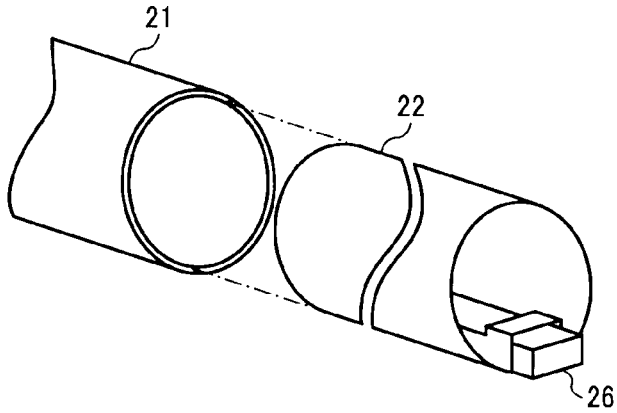
Figure 6C:
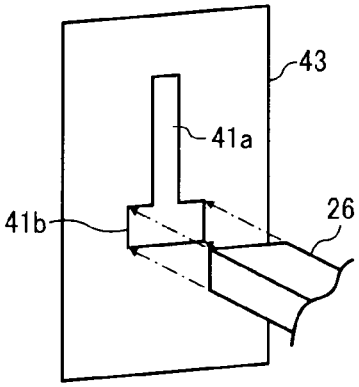
Figure 6D:
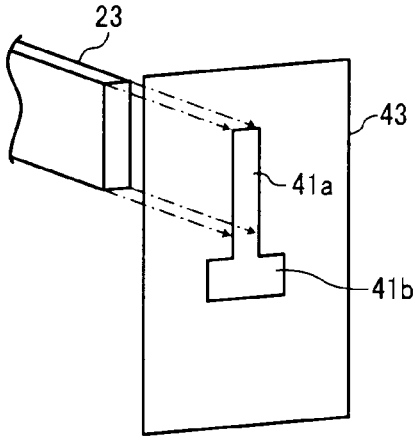

With reference to FIGS. 6A through 6D, to construct the fuser assembly, the heat pipe 22 is initially provided with the fuser pad 26 fitted into its side slot 22A (FIG. 6A). Then, the heat pipe 22 combined with the fuser pad 26 is inserted into the tubular fuser belt 21 (FIG. 6B). The heat pipe 22, the fuser pad 26, and the fuser belt 21 thus assembled into a single integrated unit is integrally mounted to the sidewalls 43, with each axial end of the fuser pad 26 engaged in the second section 41*b* of the sidewall cutout 41 (FIG. 6C). Thereafter, the reinforcing member 23 is inserted from outside into the interior of the heat pipe 22 through the sidewall cutout 41, engaging each of its axial ends in the first section 41*a* of the cutout 41 (FIG. 6D).

Provision of the side slot 22A facilitates assembly of the heat pipe 22 with the fuser pad 26 as well as with the fuser belt 21 to integrate the heat pipe 22, the fuser pad 26, and the fuser belt 21 (which are in most cases consumables) into a single integrated unit. Such integration of fuser assembly prevents variations in the size of the gap between the heat pipe 22 and the fuser belt 21, while facilitating assembly and disassembly of the fuser belt 21, the fuser pad 26, and the heat pipe 22 during repair or replacement of those consumables.

Having described the general configuration, the following describes several embodiments of the fixing device 20 with various structural and operational features according to this patent specification.

Figure 7A:
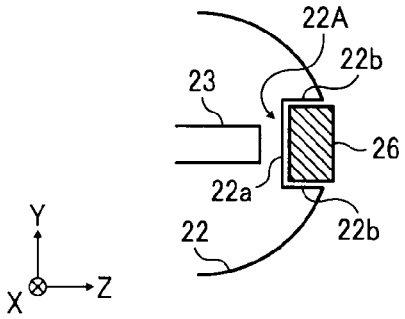
FIGS. 7A and 7B are axial cross-sectional views taken along lines A-A and B-B, respectively, of FIG. 3, schematically illustrating the fuser assembly according to a first embodiment of this patent specification.
Figure 7B:
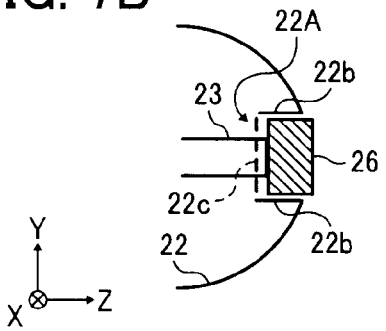

FIGS. 7A and 7B are axial cross-sectional views taken along lines A-A and B-B, respectively, of FIG. 3, schematically illustrating the fuser assembly according to a first embodiment of this patent specification, shown with several components omitted for brevity.

As shown in FIGS. 7A and 7B, the side slot 22A of the heat pipe 22 is defined by a pair of opposed, parallel walls 22*b* and a perpendicular, central wall 22*a* connecting the opposed walls 22*b*. When viewed in cross-section, the generally cylindrical loop of the heat pipe 22 is completely closed at each axial end and partially open at the axial center. That is, the opposed walls 22*b* extend along the entire axial length of the heat pipe 22, whereas the central wall 22*a* extends only at the opposed axial ends of the heat pipe 22, so that the heat pipe 22 has an opening or slit 22*c* defined at the axial center thereof. In the present embodiment, the axial ends of the heat pipe 22 extend outboard of the maximum compatible sheet width W, and the axial center is between the opposed axial ends.

Specifically, at each axial end, the heat pipe 22 has both the central wall 22*a* and the opposed walls 22*b* in contact with the fuser pad 26, so that the fuser pad 26 does not move relative to the heat pipe 22 in the load direction Z as well as in the sheet feed direction Y where pressure is applied in the load direction Z. At the axial center, the heat pipe 22 has solely the opposed walls 22*b* in contact with the fuser pad 26, so that the fuser pad 26 is displaceable in the load direction Z where it bends or bows due to an external force or pressure. For more stable connection, the fuser pad 26 and the heat pipe 22 may be secured through press-fitting or using a suitable fastening mechanism, such as screwing or bonding, at their adjoining axial ends.

The axial ends of the fuser pad 26 are retained stationary on the sidewalls 43 through engagement with the cutouts 41 as depicted with reference to FIG. 5. Such retention of the axial ends of the fuser pad 26, which establish stationary contact with the heat pipe 22, in turn maintains the axial ends of the heat pipe 22 stationary with respect to the sidewalls 43. Alternatively, instead, the axial ends of the heat pipe 22 may be held stationary in position through fitting with a pair of mounting flanges provided on the sidewalls 43.

Figure 8A:
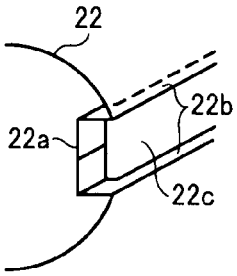
FIGS. 8A and 8B show different examples of a heat pipe for use in the fuser assembly of FIGS. 7A and 7B.
Figure 8B:
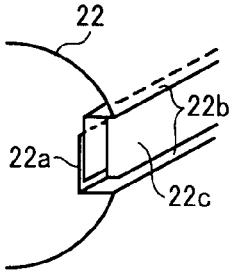

In the present embodiment, the heat pipe 22 is obtained by bending a sheet of metal into a rolled configuration, with two opposed longitudinal edges bent inward to form a side slot, which are subsequently welded together to form a closed loop at their opposed axial ends. Welding together the longitudinal edges of the metal sheet may be accomplished by a butt joint as shown in FIG. 8A, in which the two opposed edges of the bent metal sheet are abutted against each other, or a lap joint as shown in FIG. 8B, in which the two sides overlap each other for welding together at their axial ends.

Joining the opposed edges of the rolled sheet of metal to form a closed loop prevents the tubular body from "spring-back" or elastic deformation of metal after bending, leading to precise fabrication of the heat pipe in a generally cylindrical configuration.

In such a configuration, the opening 22*c* or lack of stationary contact between the heat pipe 22 and the fuser pad 26 at the axial center of the heat pipe 22 serves to relieve deformation of the fuser pad 26 between the opposed axial ends where the fuser pad 26 bends or bows under pressure in the load direction Z. That is, the deformation relief opening 22*c* accommodates the fuser pad 26 deforming in the load direction Z. Such deformation relief mechanism isolates the heat pipe 22 from pressure exerted in the load direction Z, thereby effectively protecting the thin-walled pipe 22 from deformation where the fuser pad 26 experiences a certain amount of deformation due to a change in pressure in the load direction Z.

Referring back to FIG. 3, the reinforcing member 23 is shown with a flange or protrusion 23*a* on a front side thereof facing the fuser pad 26, extending in the axial direction X inboard of the maximum compatible width of recording sheet W. With the flange 23*a* thus abutting against the fuser pad 26, the reinforcing member 23 touches the fuser pad 26 at the axial center (i.e., where the deformation relief mechanism is provided to the fuser pad 26) to support the fuser pad 26 under pressure from the pressure roller 31.

Figure 9A:
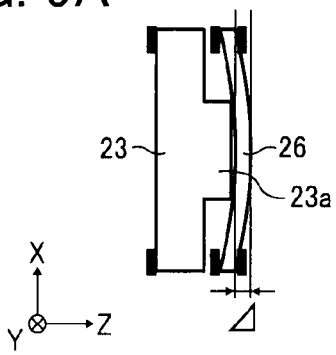
FIGS. 9A and 9B are schematic diagrams showing a flanged reinforcing member with a fuser pad in the absence and presence, respectively, of nip pressure in the fixing device of FIGS. 2 and 3.
Figure 9B:
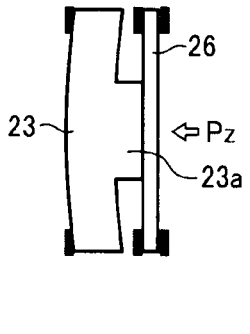

FIGS. 9A and 9B are schematic diagrams showing the flanged reinforcing member 23 with the fuser pad 26 in the absence and presence, respectively, of nip pressure Pz from the pressure roller 31 in the fixing device 20.

As shown in FIG. 9A, with no load applied, the reinforcing member 23 retains its original shape substantially straight in the axial direction X. In this state, the fuser pad 26 experiences a certain amount of deformation Δ due to the reinforcing flange 23*a* thrusting toward the pressure roller 31, wherein the axial center of the fuser pad 26 projects toward the pressure roller 31 with respect to the axial ends, which remain substantially stationary in position by being secured to the sidewalls 43.

As shown in FIG. 9B, once nip pressure Pz is applied, the reinforcing member 23 elastically bows or deforms from the original straight shape with the flange 23*a* retracting away from the pressure roller 31. In this state, the fuser pad 26 in turn regains its original shape substantially straight in the axial direction X by cancelling out the amount of deformation Δ, which forms a flat surface to face the pressure roller 31 during operation.

In the present embodiment, the depth or dimension in the load direction Z of the reinforcing flange 23*a* may be determined theoretically or empirically according to specific configurations of the fixing device. For example, where the fuser pad 26 under nip pressure experiences a maximum elastic deformation of approximately 0.5 mm away from the pressure roller 31, the reinforcing flange 23*a* is dimensioned so that the fuser pad 26 elastically deforms approximately 0.5 mm toward the pressure roller 31 in the absence of nip pressure, and regains its original straight shape by cancelling out the 0.5-mm deformation upon application of nip pressure.

Although in the present embodiment, the flange 23*a* is provided to the front side of the relatively rigid, reinforcing member 23, alternatively, instead, the protrusion or flange may be provided to the fuser pad 26 either on the rear side (i.e., the side facing the reinforcing member 23) or on the front side (i.e., the side facing the pressure roller 31).

For example, the fuser pad 26 may have its front side curving outward toward the pressure roller 31 to form a convex protrusion of a certain depth in the load direction Z. Alternatively, the fuser pad 26 may have its rear side protruding toward the reinforce member 23 by a certain depth in the load direction Z. As is the case with the embodiment depicted above, the depth of protrusion may be determined according to the maximum amount of elastic deformation experienced by the fuser pad 26 under nip pressure, so that the fuser pad 26 forms a substantially flat surface when loaded with pressure from the pressure roller 31 during operation.

As mentioned earlier, the deformation relief mechanism according to this patent specification effectively protects the thin-walled heat pipe 22 from deformation where the fuser pad 26 experiences a certain amount of deformation due to a change in pressure in the load direction Z. Such deformation relief works not only where the fuser pad 26 deforms under nip pressure from the pressure roller 31, but also where the fuser pad 26 deforms due to thrust from the flanged reinforcing member 23 as in the embodiment depicted herein.

Figure 10A:
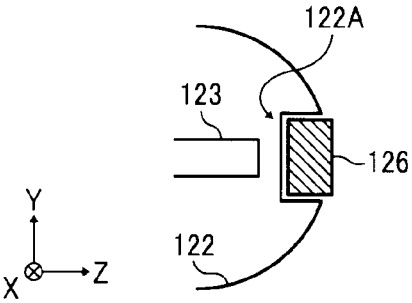
FIGS. 10A and 10B are axial cross-sectional views taken at an axial end and an axial center, respectively, of FIG. 3, schematically illustrating a comparative fuser assembly.
Figure 10B:
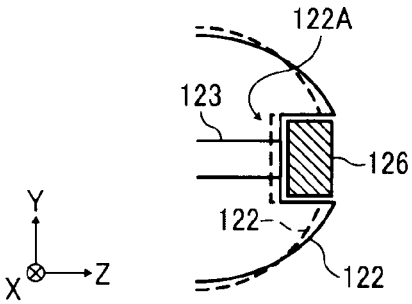

For comparison purposes, consider a fuser assembly without deformation relief to relieve deformation of a fuser pad. With reference to FIGS. 10A and 10B, which are axial cross-sectional views taken at an axial end and an axial center, respectively, of FIG. 3, a comparative fuser assembly is shown consisting of a heat pipe 122, a fuser pad 126, and a flanged reinforcing member 123, the general configuration of which is similar to that depicted in FIGS. 7A and 7B, except that the heat pipe 122 has no deformation relief opening at an axial center thereof, so that the heat pipe 122 and the fuser pad 126 establish stationary contact with each other throughout their entire axial lengths.

As shown in FIG. 10A, in the comparative fuser assembly, the cross-section of the heat pipe 122 retains its generally circular shape regardless of pressure in the load direction Z at the axial ends where the heat pipe 122 remains apart from the reinforcing member 123. As shown in FIG. 10B, the cross-section of the heat pipe 122 deforms into a non-circular, irregular shape (indicated by solid lines) from the original circular shape (indicated by broken lines) in the absence of nip pressure at the axial center where the heat pipe 122 touches the flange of the reinforcing member 123. If not corrected, such deformation of the heat pipe results in various failures of the fixing device, such as the fuser belt slipping off the heat pipe, or inconsistent heating of the fuser belt due to non-uniform contact between the fuser belt and the heat pipe.

By contrast, the fuser assembly according to this patent specification is effectively protected against deformation of the heat pipe 22 and concomitant failures of the fixing device owing to the deformation relief mechanism 22*c* isolating the thin-walled heat pipe 22 from pressure in the load direction. Provision of such deformation relief is particularly effective where the heat pipe is formed of an extremely thin sheet of material (e.g., with a thickness not exceeding 0.2 mm as in the present embodiment) for obtaining high thermal efficiency and short warm-up time, which, however, makes the heat pipe vulnerable to bending or deformation if subjected to high nip pressure or a change in pressure in the load direction.

Hence, the fixing device 20 according to this patent specification is effectively protected against deformation of the heat pipe 22, wherein the deformation relief opening 22*c* defined at the axial center of the heat pipe 22 accommodates deformation of the fuser pad 26 so as to isolate the heat pipe 22 from pressure in the load direction Z, even where the heat pipe is made of an extremely thin wall of material, or where the pressure roller presses against the fuser pad at higher nip pressures, or where the pressure roller repeatedly strikes against the fuser pad as it is positioned with respect to the fuser belt to adjust the length and pressure of the fixing nip.

Figure 11A:
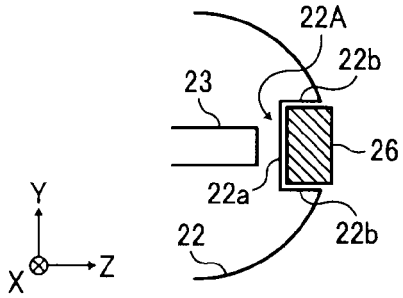
FIGS. 11A and 11B are axial cross-sectional views taken along lines A-A and B-B, respectively, of FIG. 3, schematically illustrating the fuser assembly according to a second embodiment of this patent specification.
Figure 11B:
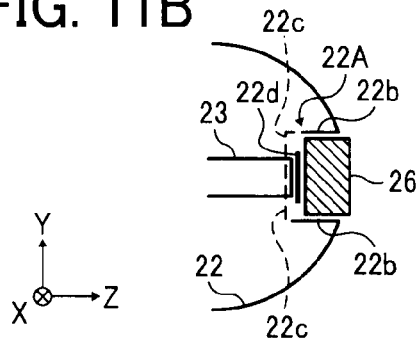

FIGS. 11A and 11B are axial cross-sectional views taken along lines A-A and B-B, respectively, of FIG. 3, schematically illustrating the fuser assembly according to a second embodiment of this patent specification.

As shown in FIGS. 11A and 11B, the overall configuration of the present embodiment is similar to that of the first embodiment, except that the heat pipe 22 is provided with a deformable wall 22*d* defined between the opposed axial ends thereof, separated from adjoining portions of the heat pipe 22 by a pair of parallel cutouts or slits 22*c* extending in the axial direction X. For brevity, those pieces of fixing equipment that are similar in configuration to the previous embodiments, including the fuser belt 21, the pressure roller 31, the thermometer 40, and the biasing mechanism, are omitted in the drawings.

Specifically, at each axial end, the heat pipe 22 has both the central wall 22*a* and the opposed walls 22*b* in contact with the fuser pad 26, so that the fuser pad 26 does not move relative to the heat pipe 22 in the load direction Z as well as in the sheet feed direction Y where pressure is applied in the load direction Z. Unlike the first embodiment, at the axial center, the heat pipe 22 has the deformable wall 22*d* in contact with the fuser pad 26, and the reinforcing member 23 presses against the deformable wall 22*d* for reinforcing the fuser pad 26 in the load direction Z.

Figure 12:
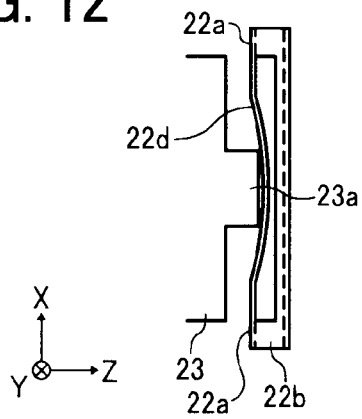
FIG. 12 schematically illustrates the flanged reinforcing member with an example of heat pipe in the absence of nip pressure in the fixing device FIGS. 2 and 3.

With reference to FIG. 12, which schematically illustrates the flanged reinforcing member 23 with the heat pipe 22 in the absence of nip pressure in the fixing device 20, thrust from the flanged reinforcing member 23 (which elastically bends or bows the fuser pad 26, not shown) deforms the deformable wall 22*d* at the axial center of the heat pipe 22 in the load direction Z. Such deformation of the deformable wall 22*d*, however, is not transmitted to the opposed walls 22*b* and other, curved portions of the heat pipe 22 facing the fuser belt 21 as the deformable wall 22*d* is isolated from the adjacent portions of the heat pipe 22 by the pair of parallel slits 22*c* disposed around the deformable wall 22*d*.

Thus, the deformable wall 22*d* at the axial center of the heat pipe 22 serves to relieve deformation of the fuser pad 26 between the opposed axial ends where the fuser pad 26 bends or bows under pressure in the load direction Z. That is, the deformation relief wall 22*d* deforms under pressure to in turn accommodate the fuser pad 26 deforming in the load direction Z. Such deformation relief mechanism isolates the heat pipe 22 from pressure exerted in the load direction Z, thereby effectively protecting the thin-walled pipe 22 from deformation where the fuser pad 26 experiences a certain amount of deformation due to a change in pressure in the load direction Z.

Figure 13:
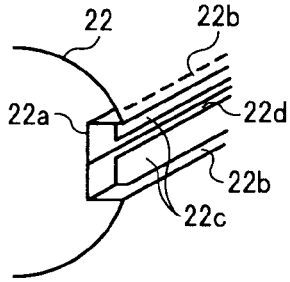
FIG. 13 shows an example of a heat pipe for use in the fuser assembly of FIGS. 11A and 11B.

In the present embodiment, the heat pipe 22 is obtained by bending a sheet of metal into a rolled configuration, with two opposed longitudinal edges bent inward to form a side slot 22A, which are subsequently welded together to form a closed loop at their opposed axial ends, followed by cutting the walls of the side slot 22A to form a pair of elongated slits and a deformable wall. Welding together the longitudinal edges of the metal sheet may be accomplished by a butt joint as shown in FIG. 13, in which the two opposed edges of the bent metal sheet are abutted against each other, or a lap joint, in which the two sides overlap each other for welding together at their axial ends.

Joining the opposed edges of the rolled sheet of metal to form a closed loop prevents the tubular body from "spring-back" or elastic deformation of metal after bending, leading to precise fabrication of the heat pipe in a generally cylindrical configuration. Moreover, such joint provided throughout the axial length results in consistent, accurate shape and dimensions at the opposed axial ends of the heat pipe, compared to separately forming joints at the opposed axial ends which can result in variations in diameter of the heat pipe due to dimensional errors occurring where the opposed edges of the bent metal sheet abut or overlap each other.

Hence, the fixing device according to the second embodiment of this patent specification is protected against deformation of the heat pipe 22, wherein provision of the deformable wall 22*d* at the axial center of the heat pipe 22 accommodates deformation of the fuser pad 26 so as to isolate the heat pipe 22 from pressure in the load direction Z, even where the fuser pad 26 contacts the heat pipe 22 not only at each axial end but also at the axial center.

Figure 14A:
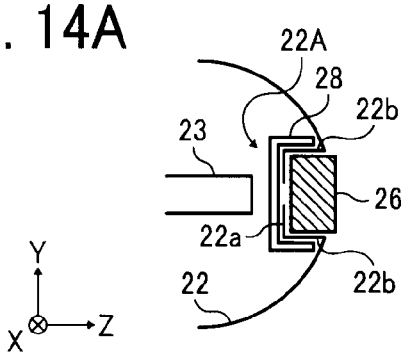
FIGS. 14A and 14B are axial cross-sectional views taken along lines A-A and B-B, respectively, of FIG. 3, schematically illustrating the fuser assembly according to a third embodiment of this patent specification.
Figure 14B:
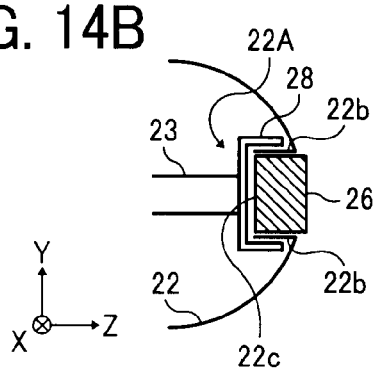

FIGS. 14A and 14B are axial cross-sectional views taken along lines A-A and B-B, respectively, of FIG. 3, schematically illustrating the fuser assembly according to a third embodiment of this patent specification.

As shown in FIGS. 14A and 14B, the overall configuration of the present embodiment is similar to that of the first embodiment, except that the cross-section of the heat pipe 22 is not completely closed throughout its axial length and the fuser pad 26 is used in conjunction with an additional, clamping stay 28. For brevity, those pieces of fixing equipment that are similar in configuration to the previous embodiments, including the fuser belt 21, the pressure roller 31, the thermometer 40, and the biasing mechanism, are omitted in the drawings.

Specifically, the clamping stay 28 comprises a rigid, elongated member with a rectangular U-shaped axial cross-section, which is formed of metal, preferably stainless steel, for obtaining sufficient strength against bending and providing a suitable foundation for reflective coating during manufacture. When installed, the clamping stay 28 surrounds the fuser pad 26 on three sides, other than the one pressed against the pressure roller 31, so that the stay 28 establishes stationary contact with the fuser pad 26 in the sheet feed direction Y and as well as in the load direction Z.

Figure 15:
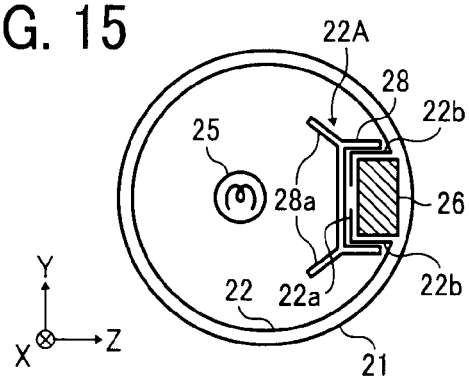
FIG. 15 schematically illustrates an arrangement of the fuser assembly of FIGS. 14A and 14B.

Further, as shown in FIG. 15, the clamping stay 28 may be configured with one or more flanges 28*a* to define a composite axial cross-section instead of a simple rectangular U-shape, which serves to reinforce the fuser assembly as a substitute for the reinforcing member 23.

Unlike the first embodiment, the heat pipe 22 in the third embodiment has a pair of opposed walls 22*a* at each axial end which do not connect to each other, instead of the central wall connecting a pair of opposed parallel walls 22*b*, so that the cross-section of the heat pipe 22 is not completely closed throughout its axial length. Such a heat pipe may be obtained by forming a sheet of metal into a rolled configuration without joining together the opposed longitudinal edges through welding. The clamping stay 28 serves to clamp together the opposed edges of the rolled metal sheet so that the heat pipe 22 retains its generally cylindrical shape without the need for welding and other joint during manufacture.

More specifically, at each axial end, the heat pipe 22 has both the central walls 22*a* and the opposed walls 22*b* closely held between the fuser pad 26 and the clamping stay 28, so that the fuser pad 26 does not move relative to the heat pipe 22 in the load direction Z as well as in the sheet feed direction Y where pressure is applied in the load direction Z. At the axial center, the heat pipe 22 has the opposed walls 22*b* loosely held between the fuser pad 26 and the clamping stay 28, so that the fuser pad 26 is displaceable in the load direction Z where it bends or bows due to an external force or pressure.

In such a configuration, the opening 22*c* or lack of stationary contact between the heat pipe 22 and the fuser pad 26 at the axial center of the heat pipe 22 serves to relieve deformation of the fuser pad 26 and the clamping stay 28 between the opposed axial ends. That is, the deformation relief opening 22*c* accommodates the fuser pad 26 or the clamping stay 28 deforming in the load direction Z. Such deformation relief mechanism isolates the heat pipe 22 from pressure exerted in the load direction Z, thereby effectively protecting the thin-walled pipe 22 from deformation where the fuser pad 26 or the clamping stay 28 experiences a certain amount of deformation due to a change in pressure in the load direction Z.

The fuser pad 26 for use with the clamping stay 28 may be similar to that depicted above with reference to FIG. 4, i.e., an elongated piece of composite structure consisting of an elastic portion 26*a* and a stiff portion 26*b*, the former formed of rubber with its exposed side defining a pliant contact surface to establish sliding contact with the pressure roller 31 through the fuser belt 21, and the latter of sufficiently stiff material, such as rigid metal or ceramic, to withstand pressure from the pressure roller 31 without deformation.

As is the case with the previous embodiments, the elastic portion 26*a* closely conforms to minute irregularities in the surface of a toner image processed through the fixing nip N for obtaining good fusing performance, with its contact surface available in various configurations according to particular applications of the fixing device 20. Where the clamping stay 28 offers sufficient strength, the fuser pad 26 may be configured without the stiff portion 26*b*.

Preferably, the clamping stay 28 is coated with light reflective material or subjected to a bright annealing or mirror polish where it faces the heater assembly 25 inside the heat pipe 22. Also, the tubular body of the heat pipe 22 may be internally coated with heat-resistant, black absorptive material where the inner circumference of the fuser belt 21 faces the heat pipe 22 outside.

Reflective treatment enables the coated area of the clamping stay 28 to repel or reflect radiation from the heaters 25, and direct it toward the side where the inner circumference of the fuser belt 21 faces the heat pipe 22 outside, leading to enhanced heating efficiency in the fixing device 20. On the other hand, absorptive coating enables the coated area of the tubular body to effectively absorb radiation from the heater assembly 25 where the inner circumference of the fuser belt 21 faces the heat pipe 22 outside, leading to enhanced heating efficiency in the fixing device 20.

Hence, the fixing device according to the third embodiment of this patent specification is effectively protected against deformation of the heat pipe 22, wherein provision of the opening 22*c* at the axial center of the heat pipe 22 accommodates deformation of the fuser pad 26 so as to isolate the heat pipe 22 from pressure in the load direction Z, even where the fuser pad 26 is used in conjunction with the clamping stay 28 disposed inside the heat pipe 22 to clamp together the opposed longitudinal edges of the rolled sheet of metal.

Figure 16A:
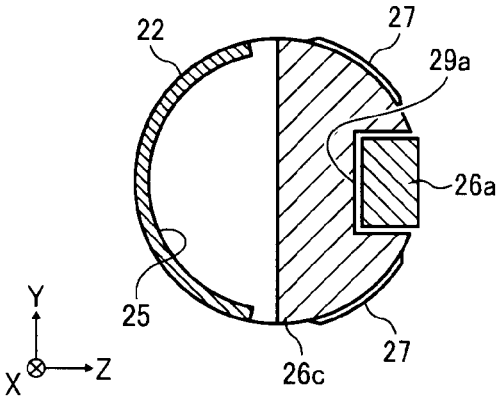
FIGS. 16A and 16B are axial cross-sectional views taken along lines A-A and B-B, respectively, of FIG. 3, schematically illustrating the fuser assembly according to a fourth embodiment of this patent specification.
Figure 16B:
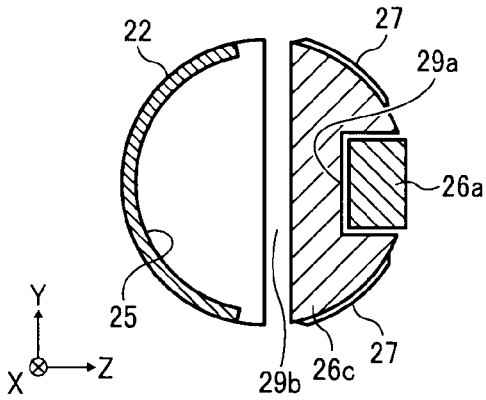

FIGS. 16A and 16B are axial cross-sectional views taken along lines A-A and B-B, respectively, of FIG. 3, schematically illustrating the fuser assembly according to a fourth embodiment of this patent specification.

As shown in FIGS. 16A and 16B, the overall configuration of the present embodiment is similar to that of the first embodiment, except for the configuration of the heat pipe 22 and the fuser pad 26, as well as the heater assembly 25 for heating the heat pipe 22. For brevity, those pieces of fixing equipment that are similar in configuration to the previous embodiments, including the fuser belt 21, the pressure roller 31, the thermometer 40, and the biasing mechanism, are omitted in the drawings.

Specifically, the heat pipe 22 in the present embodiment comprises a hollow, semi-cylindrical pipe of metal defining a completely closed, semi-circular cross-section along its entire axial length. The semi-cylindrical heat pipe 22 has one side defining a curved surface to face the inner circumference of the fuser belt 21 and another, opposite side defining a flat surface to face the fuser pad 26.

The fuser pad 26 comprises an elongated piece of composite structure consisting of an elastic portion 26*a* and a stiff portion 26*c*. The elastic portion 26*a* is formed of heat-resistant, silicone rubber with its exposed side defining a pliant contact surface to establish sliding contact with the pressure roller 31 through the fuser belt 21. The stiff portion 26*c* is a solid piece of heat-resistant resin, such as PPS, PI, or polyamide (PA), which exhibits high rigidity, low thermal conductivity, and good sliding performance.

Figure 17:
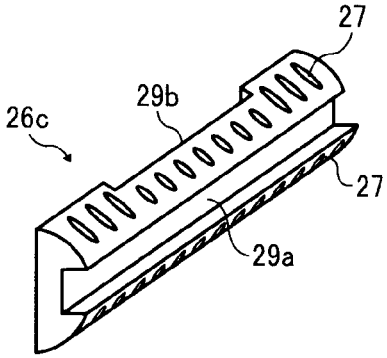
FIG. 17 schematically illustrates a stiff portion of the fuser pad for use in the fuser assembly of FIGS. 16A and 16B.

With additional reference to FIG. 17, there is shown the stiff portion 26*c* of the fuser pad 26 which has a generally semi-cylindrical configuration with its curved surface defining a first recess 29*a* to accommodate the elastic portion 26*a* therein, and another flat side defining a second recess 29*b* to face the heat pipe 22. The curved, resin-based circumference of the stiff portion 26*c*, which is less thermally conductive than metal, serves to guide the fuser belt 21 without dissipating heat during rotation. A set of multiple guide ribs 27 may be provided on the curved surface of the stiff portion 26*a* to reduce the area of contact between the fuser pad 26 and the fuser belt 21, thereby minimizing heat loss where the fuser belt 21 contacts the fuser pad 26.

The heater assembly 25 comprises a resistive heater such as a ceramic heater in the shape of a thin, flexible sheet of resistive material, which exhibits a certain resistivity to generate heat when electrified, with its opposed ends connected to a regulated power supply. The resistive heater 25 is closely attached to the inner surface of the heat pipe 22 where the heat pipe 22 faces the fuser belt 21 outside. To warm up the fuser assembly, the resistive heater 25 generates heat corresponding to an amount of electricity supplied, which in turn heats the heat pipe 22 to eventually heat the fuser belt 21 entrained therearound.

Alternatively, instead of providing a separate resistive heater, it is possible to configure the heat pipe 22 as a thin-walled pipe of resistive material with its opposed ends connected to a regulated power supply. In such cases, to warm up the fuser assembly, the heat pipe 22 itself generates heat corresponding to an amount of electricity supplied for heating the fuser belt 21 entrained therearound.

More specifically, at each axial end, the heat pipe 22 and the fuser pad 26 closely contact with each other, so that the fuser pad 26 does not move relative to the heat pipe 22 where pressure is applied in the load direction Z. At the axial center, the heat pipe 22 and the fuser pad 26 have spacing therebetween formed of the second recess 29*b* on the stiff portion 26*c* of the fuser pad 26, so that the fuser pad 26 is displaceable in the load direction Z.

In such a configuration, the spacing 29*b* or lack of stationary contact between the heat pipe 22 and the fuser pad 26 at the axial center of the heat pipe 22 serves to relieve deformation of the fuser pad 26 between the opposed axial ends where the fuser pad 26 bends or bows under pressure in the load direction Z. That is, the deformation relief spacing 29*b* accommodates the fuser pad 26 deforming in the load direction Z. Such deformation relief mechanism isolates the heat pipe 22 from pressure exerted in the load direction Z, thereby effectively protecting the thin-walled pipe 22 from deformation where the fuser pad 26 experiences a certain amount of deformation due to a change in pressure in the load direction Z.

Hence, the fixing device according to the fourth embodiment of this patent specification is effectively protected against deformation of the heat pipe 22, wherein provision of the recess 29*b* at the axial center of the fuser pad 26 accommodates deformation of the fuser pad 26 so as to isolate the heat pipe 22 from pressure in the load direction Z, even where several pieces of the fuser assembly is different in configuration than those depicted primarily with reference to FIGS. 2 and 3.

Figure 18:
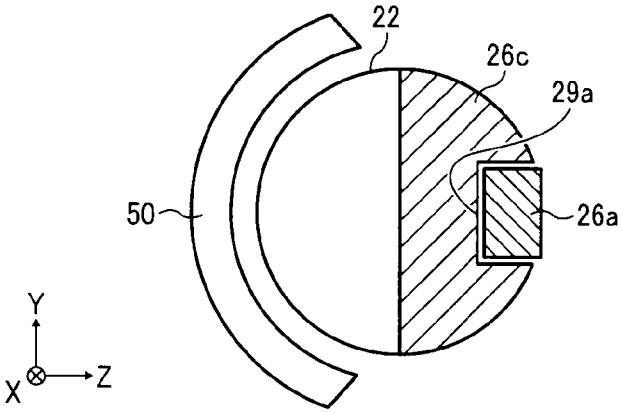
FIG. 18 is an axial cross-sectional view taken along lines A-A of FIG. 3, schematically illustrating the fuser assembly according to a fifth embodiment of this patent specification.

FIG. 18 is an axial cross-sectional view taken along lines A-A of FIG. 3, schematically illustrating the fuser assembly according to a fifth embodiment of this patent specification.

As shown in FIG. 18, the overall configuration of the present embodiment is similar to that of the fourth embodiment, including the combination of the semi-cylindrical heat pipe 22 and the semi-cylindrical fuser pad 26, except that it employs an induction heater 50 that heats the pipe circumference by electromagnetic induction instead of radiation with the radiant heaters 25. For brevity, those pieces of fixing equipment that are similar in configuration to the previous embodiments, including the fuser belt 21, the pressure roller 31, the thermometer 40, and the biasing mechanism, are omitted in the drawing.

Specifically, the induction heater 50 consists of a set of electromagnetic coils or Litz wires each being a bundle of thinner wires extending across a portion of the fuser belt 21 in the axial direction X and opposed to a semi-cylindrical main core formed of a ferromagnetic material with a high magnetic permeability ranging from approximately 1,000 to approximately 3,000, and optionally equipped with auxiliary central and/or side cores for efficient formation of magnetic flux, all of which are held by a coil support of suitable material such as heat resistant resin or the like. Although in the embodiment depicted in FIG. 17, the induction heater 50 is disposed outside the heat pipe 22, instead, it is also possible to install the induction heater 50 within the closed interior of the heat pipe 22.

During operation, the induction heater 50 generates an alternating magnetic field around the heat pipe 22 as a high-frequency alternating current passes through the electromagnetic coils. The changing magnetic field induces eddy currents over the circumference of the heat pipe 22, which exhibits certain electrical resistivity to produce a corresponding amount of Joule heat from within.

The heat pipe 22 thus heated through electromagnetic induction releases heat to the length of the fuser belt 21 rotating in the proximity of the pipe circumference, resulting in heating the fixing nip N to a desired processing temperature.

For maximizing heating efficiency through electromagnetic induction, preferably, the heat pipe 22 is made of any suitable metal, including, but not limited to, nickel, stainless steel, iron, copper, cobalt, chromium, aluminum, gold, platinum, silver, tin, palladium, and alloys containing one or more of these metals.

Hence, the fixing device according to the fifth embodiment of this patent specification is effectively protected against deformation of the heat pipe 22, wherein provision of the recess 29*b* at the axial center of the fuser pad 26 accommodates deformation of the fuser pad 26 so as to isolate the heat pipe 22 from pressure in the load direction Z, even where heating the heat pipe 22 is accomplished through use of an induction heater.

To recapitulate, the fixing device 20 according to this patent specification can operate with extremely short warm-up time and first-print time without failures caused by insufficient heating in high speed application owing to the thin-walled, thermally conductive heat pipe 22 that allows for immediate heating of the fuser belt 21.

In the fixing device 20, provision of the heat pipe 22 with the side slot 22A for accommodating the fuser pad 26 facilitates ready assembly and disassembly during manufacture and maintenance of the fixing device 20. Moreover, establishing stationary contact between the fuser pad 26 and the heat pipe 22 at their respective axial ends maintains a proper gap or clearance between the adjoining surfaces of the fuser belt 21 and the heat pipe 22, which stabilizes rotation of the fuser belt while ensuring good thermal efficiency in heating the fuser belt.

In particular, the fixing device 20 is effectively protected against deformation of the heat pipe 22, wherein the deformation relief mechanism provided to at least one of the heat pipe 22 and the fuser pad 26 at the axial center thereof accommodates deformation of the fuser pad 26 so as to isolate the heat pipe 22 from pressure in the load direction Z, even where the heat pipe is made of an extremely thin wall of material, or where the pressure roller presses against the fuser pad at higher nip pressures, or where the pressure roller repeatedly strikes against the fuser pad as it is positioned with respect to the fuser belt to adjust the length and pressure of the fixing nip.

The fixing device according to this patent specification may be configured with various types of fuser assemblies and various types of heating mechanism. In any such configuration, the fixing device provides reliable, high-speed imaging performance with high immunity to deformation of the heat pipe under nip pressure.

Further, although the embodiments described above employ a pressure roller, the fixing device according to this patent specification may be configured with any suitable type of rotatable body to press against a fuser pad to form a fixing nip.

Furthermore, although the embodiments described above employ a multi-layered fuser belt formed of a substrate combined with elastic and releasing layers, the fixing device according to this patent specification may be configured with any suitable type of endless belt or film, formed of any one or combination of polyimide, polyamide, fluorine resin, and metal, looped for rotation around the heat pipe while heated. In any such configuration, the fixing device provides reliable, high-speed imaging performance with high immunity to deformation of the heat pipe under nip pressure.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device comprising:

a frame to define a space in which the fixing device is installed;

a tubular heat pipe extending in an axial direction with a pair of opposed axial ends thereof held stationary with respect to the frame, a circumference of the heat pipe subjected to heating;

a flexible fuser belt looped for rotation around the heat pipe, an inner circumference thereof at least partially facing the heat pipe to transfer heat from the heated circumference of the heat pipe;

a fuser pad extending in the axial direction inside the loop of the fuser belt and parallel to the heat pipe, with a pair of opposed axial ends thereof held stationary with respect to the frame;

a pressure member extending opposite the heat pipe in the axial direction, with the fuser belt interposed between the fuser pad and the pressure member, the fuser pad being pressed against the pressure member through the fuser belt in a load direction perpendicular to the axial direction to form a fixing nip through which a recording medium is passed to fix a toner image thereupon under heat and pressure, the heat pipe and the fuser pad establishing stationary contact with each other at their respective opposed axial ends upon formation of the fixing nip; and a deformation relief mechanism provided to at least one of the heat pipe and the fuser pad to relieve deformation of the fuser pad between the opposed axial ends where the fuser pad bends under pressure in the load direction, wherein the opposed axial ends of the fuser pad, which establish stationary contact with the heat pipe, maintain the opposed axial ends of the heat pipe stationary with respect to sidewalls.

2. The fixing device according to claim 1, wherein the deformation relief mechanism comprises an opening provided to the heat pipe between the opposed axial ends of the heat pipe to accommodate the fuser pad deforming in the load direction.

3. The fixing device according to claim 1, wherein the deformation relief mechanism comprises a deformable wall provided to the heat pipe between the opposed axial ends of the heat pipe, separated from adjoining portions of the heat pipe by a pair of parallel slits extending in the axial direction, which can deform under pressure to accommodate the fuser pad deforming in the load direction.

4. The fixing device according to claim 1, wherein the deformation relief mechanism comprises a recess provided to the fuser pad between the opposed axial ends of the fuser pad, which forms a spacing between the heat pipe and the fuser pad to accommodate the fuser pad deforming in the load direction.

5. The fixing device according to claim 1, wherein the fuser pad includes:

an elastic portion disposed on a first side to face the pressure member through the fuser belt at the fixing nip; and a stiff portion disposed on a second side opposite the first side to support pressure from the pressure member.

6. The fixing device according to claim 1, wherein an axial center of the fuser pad protrudes toward the pressure member relative to the opposed axial ends where no pressure is applied from the pressure member.

7. The fixing device according to claim 1, further comprising a reinforcing member extending in the axial direction inside the heat pipe to reinforce the fuser pad in the load direction, wherein the reinforcing member has a pair of opposed axial ends thereof secured to the frame, and an axial center thereof flanged to contact the fuser pad.

8. The fixing device according to claim 1, wherein the heat pipe and the fuser pad establish stationary contact with each other outboard of a maximum compatible width of a recording medium that the fixing device can accommodate through the fixing nip.

9. The fixing device according to claim 1, wherein the heat pipe comprises a sheet of material approximately 0.2 millimeters thick or less formed into a rolled, at least partially cylindrical configuration.

10. An image forming apparatus comprising:

an electrophotographic imaging unit to form a toner image on a recording medium; and a fixing device to fix the toner image in place on the recording medium, the fixing device including:

a frame to define a space in which the fixing device is installed;

a tubular heat pipe extending in an axial direction with a pair of opposed axial ends thereof held stationary with respect to the frame, a circumference of the heat pipe subjected to heating;

a flexible fuser belt looped for rotation around the heat pipe, an inner circumference thereof at least partially facing the heat pipe to transfer heat from the heated circumference of the heat pipe;

a fuser pad extending in the axial direction inside the loop of the fuser belt and parallel to the heat pipe, with a pair of opposed axial ends thereof held stationary with respect to the frame;

a pressure member extending opposite the heat pipe in the axial direction with the fuser belt interposed between the fuser pad and the pressure member, the fuser pad being pressed against the pressure member through the fuser belt in a load direction perpendicular to the axial direction to form a fixing nip through which the recording medium is passed to fix the toner image thereupon under heat and pressure, the heat pipe and the fuser pad establishing stationary contact with each other at their respective opposed axial ends upon formation of the fixing nip; and a deformation relief mechanism provided to at least one of the heat pipe and the fuser pad to relieve deformation of the fuser pad between the opposed axial ends where the fuser pad bends under pressure in the load direction, wherein the opposed axial ends of the fuser pad which establish stationary contact with the heat pipe, maintain the opposed axial ends of the heat pipe stationary with respect to sidewalls.

11. A fixing device comprising:

a frame to define a space in which the fixing device is installed;

a tubular heat pipe extending in an axial direction with a pair of opposed axial ends thereof held stationary with respect to the frame, a circumference of the heat pipe subjected to heating;

a flexible fuser belt looped for rotation around the heat pipe, an inner circumference thereof at least partially facing the heat pipe to transfer heat from the heated circumference of the heat pipe;

a fuser pad extending in the axial direction inside the loop of the fuser belt and parallel to the heat pipe, with a pair of opposed axial ends thereof held stationary with respect to the frame;

a pressure member extending opposite the heat pipe in the axial direction, with the fuser belt interposed between the fuser pad and the pressure member, the fuser pad being pressed against the pressure member through the fuser belt in a load direction perpendicular to the axial direction to form a fixing nip through which a recording medium is passed to fix a toner image thereupon under heat and pressure, the heat pipe and the fuser pad establishing stationary contact with each other at their respective opposed axial ends upon formation of the fixing nip; and a deformation relief mechanism provided to at least one of the heat pipe and the fuser pad to relieve deformation of the fuser pad between the opposed axial ends where the fuser pad bends under pressure in the load direction, wherein the deformation relief mechanism comprises a deformable wall provided to the heat pipe between the opposed axial ends of the heat pipe, separated from adjoining portions of the heat pipe by a pair of parallel slits extending in the axial direction, which can deform under pressure to accommodate the fuser pad deforming in the load direction.

12. An image forming apparatus comprising:

an electrophotographic imaging unit to form a toner image on a recording medium; and a fixing device to fix the toner image in place on the recording medium, the fixing device including:

a frame to define a space in which the fixing device is installed;

a tubular heat pipe extending in an axial direction with a pair of opposed axial ends thereof held stationary with respect to the frame, a circumference of the heat pipe subjected to heating;

a flexible fuser belt looped for rotation around the heat pipe, an inner circumference thereof at least partially facing the heat pipe to transfer heat from the heated circumference of the heat pipe;

a fuser pad extending in the axial direction inside the loop of the fuser belt and parallel to the heat pipe, with a pair of opposed axial ends thereof held stationary with respect to the frame;

a pressure member extending opposite the heat pipe in the axial direction with the fuser belt interposed between the fuser pad and the pressure member, the fuser pad being pressed against the pressure member through the fuser belt in a load direction perpendicular to the axial direction to form a fixing nip through which the recording medium is passed to fix the toner image thereupon under heat and pressure, the heat pipe and the fuser pad establishing stationary contact with each other at their respective opposed axial ends upon formation of the fixing nip; and a deformation relief mechanism provided to at least one of the heat pipe and the fuser pad to relieve deformation of the fuser pad between the opposed axial ends where the fuser pad bends under pressure in the load direction, wherein the deformation relief mechanism comprises a deformable wall provided to the heat pipe between the opposed axial ends of the heat pipe, separated from adjoining portions of the heat pipe by a pair of parallel slits extending in the axial direction, which can deform under pressure to accommodate the fuser pad deforming in the load direction.

* * * * *